US006188747B1

(12) United States Patent
Geus et al.

(10) Patent No.: US 6,188,747 B1
(45) Date of Patent: Feb. 13, 2001

(54) X-RAY GENERATOR

(75) Inventors: Georg Geus, Wiesbaden; Kurt Foos, Nauheim, both of (DE)

(73) Assignee: Heimann Systems GmbH, Wiesbaden (DE)

( * ) Notice: Under 35 U.S.C. 154(b), the term of this patent shall be extended for 0 days.

(21) Appl. No.: 09/236,458

(22) Filed: Jan. 25, 1999

(30) Foreign Application Priority Data

Jan. 24, 1998 (DE) ..... 198 02 668

(51) Int. Cl.[7] ..... H01J 35/08
(52) U.S. Cl. ..... 378/124; 378/119; 378/121
(58) Field of Search ..... 378/98.9, 119, 378/121, 124, 134, 136, 143, 144

(56) References Cited

U.S. PATENT DOCUMENTS

| | | | | |
|---|---|---|---|---|
| 2,350,642 | * | 6/1944 | Schwarzer | 378/124 |
| 2,597,498 | * | 5/1952 | Verkhoff | 378/124 |
| 2,900,542 | * | 8/1959 | McEuen | 378/109 |
| 3,610,984 | * | 10/1971 | Seki et al. | 378/125 |
| 3,644,970 | * | 2/1972 | Seki et al. | 445/28 |
| 3,753,020 | * | 8/1973 | Zingaro | 378/141 |
| 3,821,580 | * | 6/1974 | Alexandrovich et al. | 378/122 |
| 4,000,433 | * | 12/1976 | Rohmfeld | 378/143 |
| 4,622,688 | * | 11/1986 | Diemer et al. | 378/143 |
| 4,870,671 | * | 9/1989 | Hershyn | 378/124 |
| 5,511,105 | * | 4/1996 | Knott | 378/134 |

FOREIGN PATENT DOCUMENTS

| | | |
|---|---|---|
| 31 39 899 | 4/1983 | (DE) . |
| 36 35 395 | 7/1995 | (DE) . |
| 1 311 321 | 3/1973 | (GB) . |
| 2 212 975 | 8/1989 | (GB) . |
| 2 281 812 | 3/1995 | (GB) . |

* cited by examiner

*Primary Examiner*—David P. Porta
*Assistant Examiner*—Allen C. Ho
(74) *Attorney, Agent, or Firm*—Venable; Gabor J. Kelemen

(57) ABSTRACT

An X-ray generating system includes a first high-voltage source generating a first high voltage; a second high=voltage source generating a second high voltage different from the first high voltage; and an X-ray generator. The X-ray generator includes a first assembly having a first cathode and a first anode for emitting a first X-ray beam from a first focal point on the first anode upon application of the first high voltage to the first assembly. The X-ray generator further includes a second assembly having a second cathode and a second anode for emitting a second X-ray beam from a second focal point on the second anode upon application of the second high voltage to the second assembly. The two X-ray beams exit the X-ray generator parallel to one another.

8 Claims, 3 Drawing Sheets

X-RAY GENERATOR

CROSS REFERENCE TO RELATED APPLICATION

This application claims the priority of German Application No. 198 02 668.4 filed Jan. 24, 1998, which is incorporated herein by reference.

BACKGROUND OF THE INVENTION

This invention relates to an X-ray generator having a first high-voltage source and an X-ray tube which is provided with an anode, a first cathode and a second cathode which is electrically independent from the first cathode. A first high voltage supplied by the first high-voltage source is applied to a first system formed by the anode and the first cathode to obtain a first X-ray radiation. Further, the X-ray generator includes a second high-voltage source which delivers a high voltage different from the first high voltage.

Current X-ray apparatus used in security systems for examining freight and packages, are capable of distinguishing materials from one another, in addition to producing a shadow image of the contents. For such an operation the object under examination has to be irradiated with X-ray beams having two different discreet energy levels or energy level ranges. According to a technical solution, two sequential fan-shaped X-ray beams are generated which consecutively pass through the object. The energy levels of the fan-shaped beams are different, and thus a comparison of the spectra to be examined and derived from the object leads to a material classification.

For effecting a classification of material, it is known to arrange mechanically side-by-side two X-ray tubes for X-ray generators having different limit energy levels. For reasons of mechanical and high-voltage technology such X-ray generators require a certain minimum volume, and therefore the distance between the two fan-shaped beams has a minimum limit value which cannot be reduced. Such a circumstance, however, leads to technological disadvantages, particularly caused by mechanical tolerances, drifts in temperature and wear which lead to erroneous measuring data and thus adversely affect the accuracy of the measuring system.

German Patent No. 3,635,395 discloses an X-ray generator for producing at least two different X-ray radiations. The X-ray tube of the generator has at least two mutually independent cathodes which cooperate with an anode at different high voltages. Two or more X-ray beams are generated at different locations on a side of the anode.

German Offenlegungsschrift (application published without examination) No. 31 39 899 discloses an X-ray tube having two annular anodes and a cathode arrangement which encircles the anodes. In the annular anodes an opening is provided into or between which the material to the examined may be introduced.

SUMMARY OF THE INVENTION

It is an object of the invention to provide an improved X-ray generator with which a material classification for objects to be X-rayed is simplified.

This object and others to become apparent as the specification progresses, are accomplished by the invention, according to which briefly stated, an X-ray generating system includes a first high-voltage source generating a first high voltage; a second high-voltage source generating a second high voltage different from the first high voltage; and an X-ray generator. The X-ray generator includes a first assembly having a first cathode and a first anode for emitting a first X-ray beam from a first focal point on the first anode upon application of the first high voltage to the first assembly. The X-ray generator further includes a second assembly having a second cathode and a second anode for emitting a second X-ray beam from a second focal point on the second anode upon application of the second high voltage to the second assembly. The two X-ray beams exit the X-ray generator parallel to one another.

The invention is based on the principle to provide an X-ray generator having two cathode systems and two anode systems to obtain two internal, mutually separate radiation sources. The anode systems are integrated in an anode head which is preferably a copper block situated between the two cathode systems. The cathode systems each include a conventional heating filament for the electron emission and an electrostatic lens.

By applying different high voltages to the bremsstrahlung (braking radiation) sources, different energy spectra are generated on the anodes. In this manner two radiation sources are provided which are distinctly defined and locally separated from one another and are nevertheless situated closely side-by-side. A shielding hood prevents a mutual interference or cross-mixing of the two radiation levels or radiation ranges. Mechanical tolerances of the two radiation systems are small and reproducible because of the common structure. The mechanical dimensions of the two-beam system are significantly reduced.

By virtue of the construction of the X-ray generator as a dual energy X-ray generator according to the invention, a dual focusing system is provided which may be positioned as closely as 20 mm from one another. Apart from a more accurate measurement, such an arrangement also achieves a shorter run-through period for the objects to be examined since the distance of the fan-shaped X-ray beams from one another is reduced. In addition, an in situ setting is significantly simplified. Also, an adjustment of the X-ray radiations with respect to one another is dispensed with.

DESCRIPTION OF THE PREFERRED EMBODIMENTS

Figure 1:
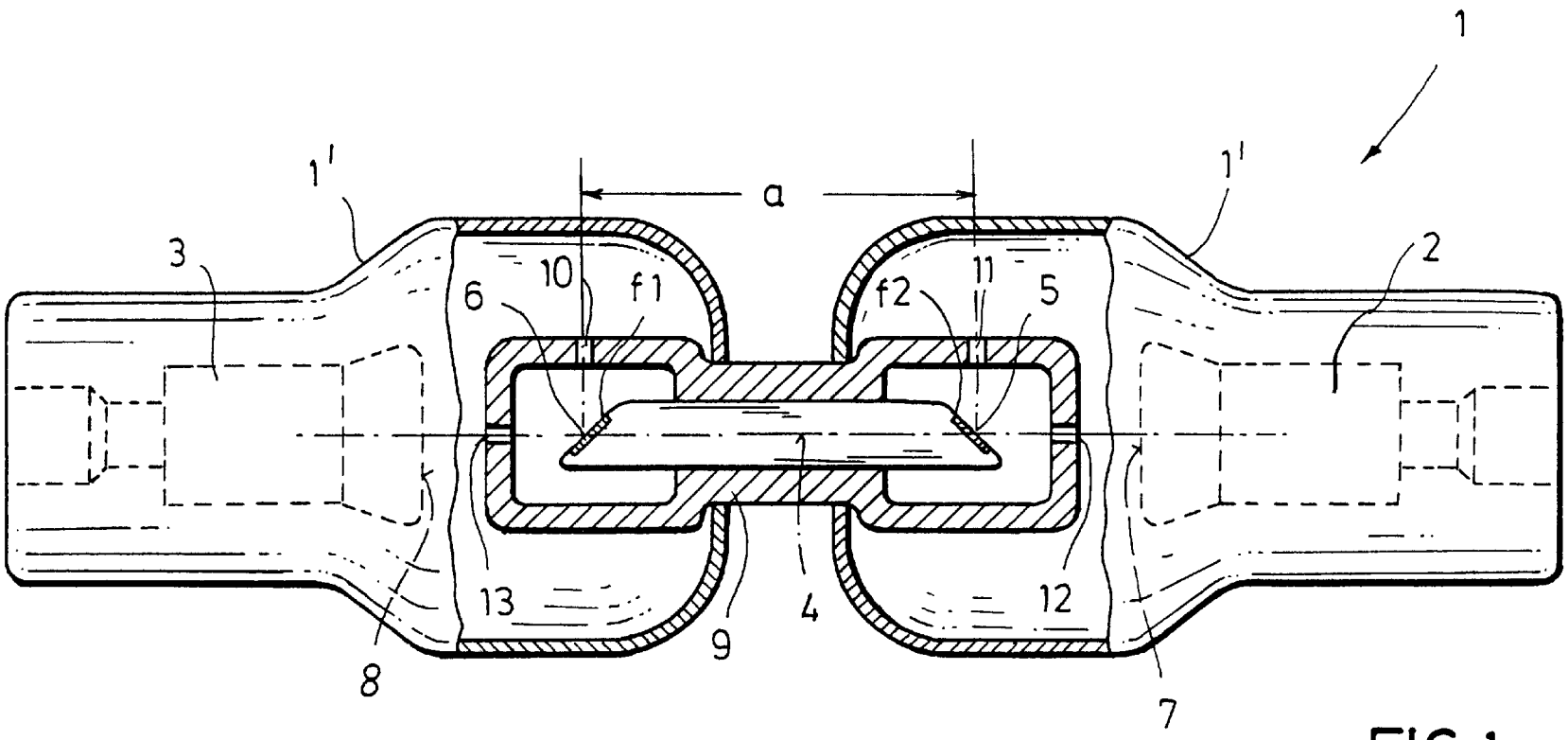
FIG. 1 is an axial sectional view of a preferred embodiment of the invention.

FIG. 1 illustrates a dual energy X-ray generator 1 according to the invention, including a glass envelope 1' accommodating two cathode systems 2, 3 as well as an anode head 4 in which two anode systems 5 and 6 are integrated and are positioned at a distance a from on another. On focal points f1 and f2 of the respective anode systems 6 and 5 bremsstrahlungs (braking radiations) are generated by means of an electron bombardment. The cathode systems 2, 3 have non-illustrated conventional heater filaments for emitting electrons and further have electrostatic lenses 7 and 8. The anode head 4 is preferably of copper and is located between the two cathode systems 2, 3. A shielding hood 9 surrounds the anode head 4 and is provided with apertures 10, 11, 12 and 13. The shielding hood 9 is made preferably of a heavy metal such as tungsten and serves as an internal radiation protection.

The apertures 10 and 11 are situated directly above the focal points f1 and f2 and permit passage of the X-rays FX1, FX2 from the X-ray generator 1. The apertures 10 and 11 also serve as collimators since they guide the X-rays FX1 and FX2 in a parallel relationship our of the X-ray generator 1. The apertures 12 and 13 serve as inlet openings for the electron beams generated by the conventional cathode systems 2 and 3.

Figure 2:
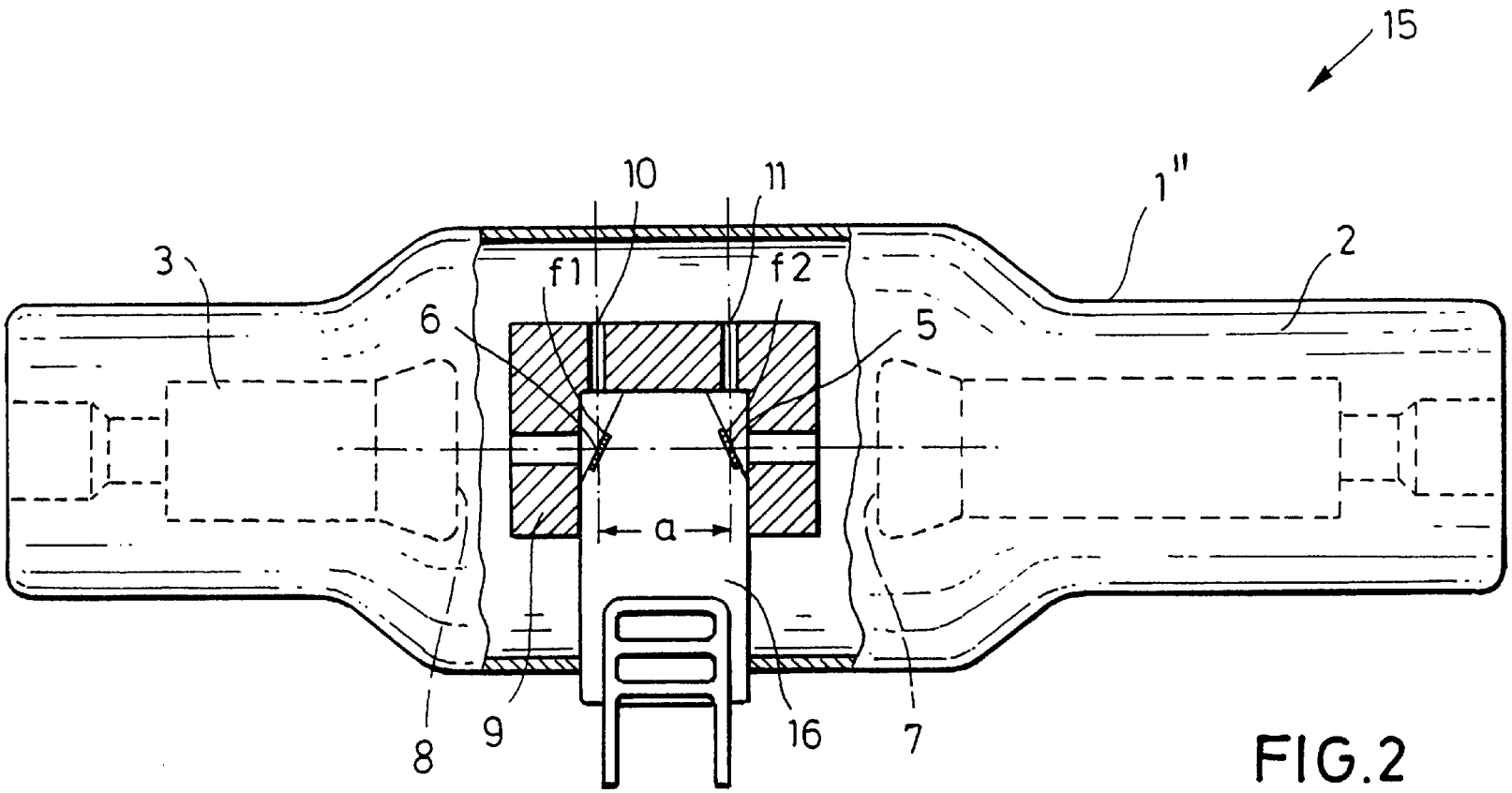
FIG. 2 is an axial sectional view of another preferred embodiment of the invention.

FIG. 2 illustrates an X-ray generator 15 which differs from the X-ray generator 1 of FIG. 1 in that the anode head 16 is partially surrounded by a shielding hood 9' in a U-shaped manner, rather than being entirely surrounded as in the FIG. 1 embodiment and also, the glass envelope 1" is a one-piece component.

Figure 3:
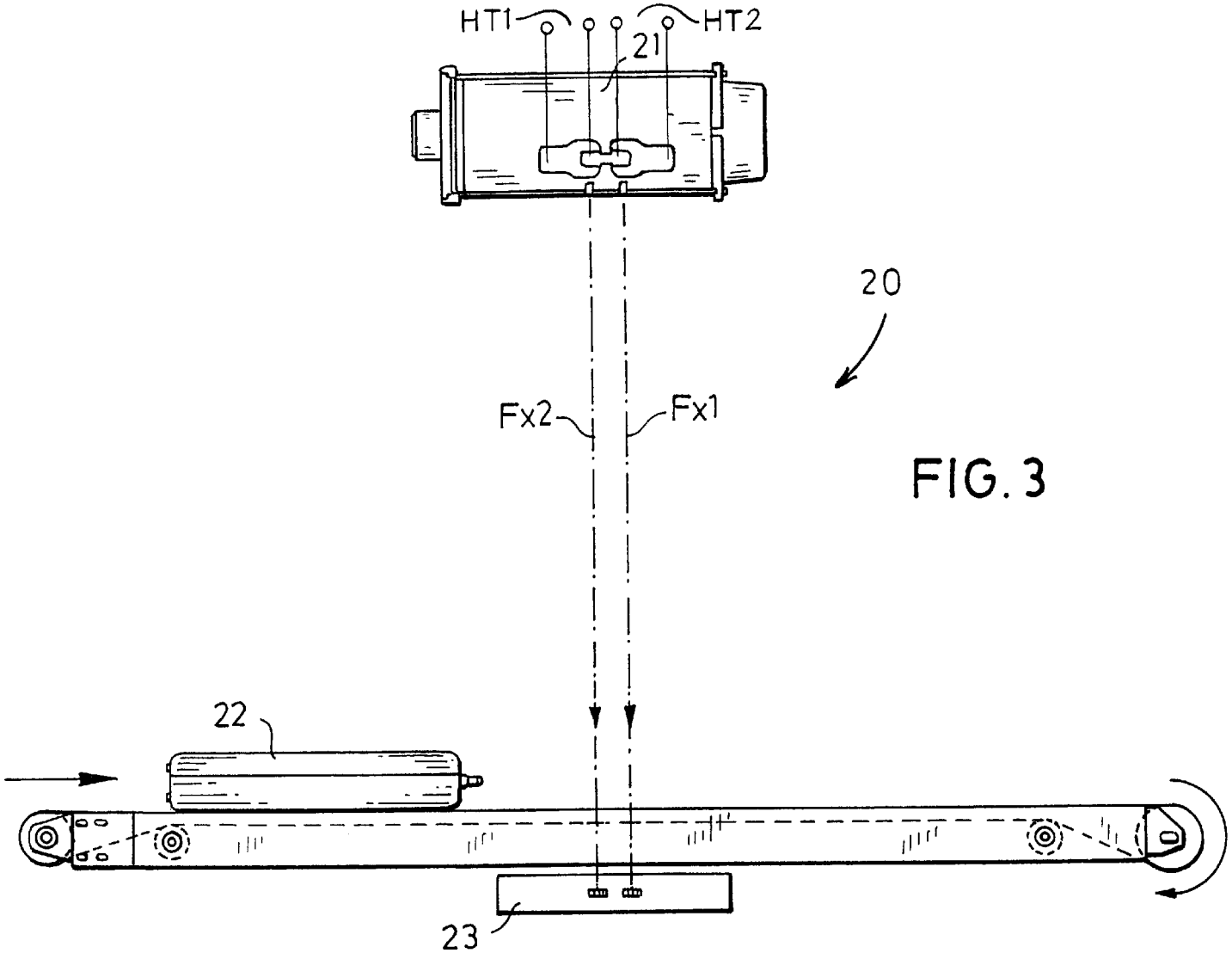
FIG. 3 is a schematic side elevational view of a baggage examining system incorporating the invention.

In the description which follows, the operation of the X-ray generator 1 shown in FIG. 1 will be set forth, while reference is also made to FIG. 3. It is noted that the X-ray generator 15 of FIG. 2 operates in an identical manner.

By applying different high voltages from two high-voltage sources HT1 and HT2 to the X-ray generator 1 in an X-ray system 21 forming part of an X-ray examination system 20, on the anodes 5 and 6 different energy spectra are generated. Such energy spectra or ranges lie between 30 and 70 KeV at 70 KV in the first system formed of the anode system 6 and the cathode system 3, and between 30 and 140 KeV at 140 KV in the second system formed of the anode system 5 and the cathode system 2. The two different high voltages from the voltage source HT1 and HT2 are provided in a conventional manner in the X-ray system 21.

The X-rays FX1 and FX2 generated in this manner exit from the X-ray generator 1 through the apertures 10 and 11 and, in a fan-shaped configuration, pass through an object 22 situated within the examining system 20. The X-rays FX1 and FX2 are received by a conventional detector unit 23 situated on the opposite side of the object 22. Expediently, the detector unit 23 is formed of separate linear detector bands for the respective X-rays FX1 and FX2. Each detector bank is formed of a plurality of X-ray sensitive detectors (not shown) which are connected to further processing means (also not shown) for reconstructing the shadow image of the contents of the object and for determining the material of the irradiated object 22.

The scanning of the object 22 is effected by guiding it conventionally past the X-ray generator 1 or by moving the entire X-ray generator 1 with or without the X-ray system 21.

The X-ray generators 1 and 15 structured according to the invention are easy to manufacture. The anodes 5 and 6 as well as the cathodes 2 and 3 are conventionally manufactured as individual components on which two glass envelopes 1' (FIG. 1) or a single glass envelope 1" (FIG. 2) are fused.

It will be understood that the above description of the present invention is susceptible to various modifications, changes and adaptations, and the same are intended to be comprehended within the meaning and range of equivalents of the appended claims.

What is claimed is:

1. An X-ray generating system comprising (a) a first high-voltage source generating a first high voltage;

(b) a second high-voltage source generating a second high voltage different from said first high voltage; and (c) an X-ray generator including (1) a first assembly having (i) a first cathode; and (ii) a first anode emitting a first X-ray beam from a first focal point of said first anode upon application of said first high voltage to said first assembly;

(2) a second assembly having (i) a second cathode; and (ii) a second anode emitting a second X-ray beam from a second focal point of said second anode parallel to said first X-ray beam upon application of said second high voltage to said second assembly; and (3) an anode head carrying said first and second anodes and disposed between said first and second cathodes.

2. The X-ray generating systems as defined in claim 1, wherein said anode head is of copper.

3. The X-ray generating system as defined in claim 1, further comprising a shielding hood at least partially surrounding said anode head; said anode head having first and second apertures aligned with respective said first and second focal points for allowing passage of said first and second X-ray beams through said shielding hood; said first and second apertures constituting collimators.

4. The X-ray generating system as defined in claim 3, wherein said shielding hood surrounds said anode head on three side thereof.

5. The X-ray generating systems as defined in claim 3, wherein said shielding hood further has (a) a third aperture aligned with said first cathode and said first anode and being oriented perpendicularly to said first aperture; and (b) a fourth aperture aligned with said second cathode and said second anode and being oriented perpendicularly to said second aperture.

6. The X-ray generating system as defined in claim 3, wherein said shielding hood entirely surrounds said anode head.

7. The X-ray generating system as defined in claim 3, wherein said shielding hood is of a heavy metal.

8. The X-ray generating systems as defined in claim 7, wherein said heavy metal is a heavy-isotope tungsten.

* * * * *